US006619990B2

(12) United States Patent
Douglass et al.

(10) Patent No.: US 6,619,990 B2
(45) Date of Patent: Sep. 16, 2003

(54) SHORT-CIRCUIT CURRENT LIMITER

(75) Inventors: Robert S. Douglass, Wildwood, MO (US); Matthew R. Darr, Alton, IL (US); Matthew A. Joiner, Fenton, MO (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/945,279

(22) Filed: Aug. 31, 2001

(65) Prior Publication Data

US 2003/0045167 A1 Mar. 6, 2003

(51) Int. Cl.[7] ..... H01R 13/68
(52) U.S. Cl. ..... 439/621
(58) Field of Search ..... 439/250, 366, 439/621, 622, 698, 830, 890, 893; 337/158, 208

(56) References Cited

U.S. PATENT DOCUMENTS 4,514,723 A * 4/1985 Leal ..... 340/638
5,294,905 A * 3/1994 Pimpis ..... 337/158
5,296,832 A * 3/1994 Perreault et al. ..... 337/158
5,821,849 A * 10/1998 Dietsch et al. ..... 337/241
6,326,878 B1 * 12/2001 Liang ..... 337/215

OTHER PUBLICATIONS

Cooper Patent Application Request Photograph of Bussmann Part No. LAC–50–100.

* cited by examiner

*Primary Examiner*—Renee Luebke
*Assistant Examiner*—Ann McCamey
(74) *Attorney, Agent, or Firm*—Armstrong Teasdale LLP

(57) ABSTRACT

A short circuit current limiter is disclosed which includes fuse elements configured in one of a folded back configuration or a switch back configuration, a plurality of contact terminals, one contact terminal electrically connected to each end of each fuse element, a terminal base for mechanically mounting the fuse elements and contact terminals, and a cover configured to engage the terminal base to protect the fuse elements.

20 Claims, 8 Drawing Sheets

SHORT-CIRCUIT CURRENT LIMITER

BACKGROUND OF THE INVENTION

This invention relates generally to fuses, and, more particularly, to current limiters which provide short circuit protection.

Fuses are widely used as overcurrent protection devices to prevent costly damage to electrical circuits. An overcurrent condition may be attributable to an overload current, that is, an excessive current relative to a normal operating currents found in the electrical circuit and confined to the conductive paths of the electrical circuit. Additionally, an overcurrent condition may constitute a short circuit condition, or current flowing outside the normal conducting paths of the electrical circuit. Short circuit currents are also sometimes referred to as fault currents.

Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and opens one or more circuit through the fuses to prevent electrical component damage. In certain applications, fuses will not open from overload currents due to temporary surges in drawn current occurring in, for example, starting of motors and energization of transformers. The temporary surges are typically between one and six times a normal current level, and usually will not cause damage to components of the electrical circuit unless the overload condition is sustained over a length of time. Fuses typically do not react to an overload current of a short duration.

Fuses also protect against short circuit currents, which can be as high as many hundreds of times larger than normal operating currents, and therefore require rapid isolation in order to protect the electrical components.

Circuit breakers are also widely used as overcurrent protection devices to protect electrical circuits. While circuit breakers provide overload protection, known mechanical circuit breakers provide limited short circuit interruption capability compared to fuses. Adding additional fuse protection to achieve or extend a short circuit interruption rating in a circuit which is already overload protected using circuit breakers, however, increases costs of circuit protection and is typically not a space efficient solution.

An alternative solution to providing extended short circuit protection capability in a circuit protected by circuit breaker is to use higher priced circuit breakers for the application that is being protected. For most customers, the prospect of having to purchase a higher priced circuit breaker is an unattractive solution.

BRIEF SUMMARY OF THE INVENTION

In one aspect of the invention, a short circuit current limiter is provided which comprises at least one fuse element which includes a first end and a second end. The fuse element incorporates one of a folded back configuration or a switch back configuration. The current limiter further comprises a plurality of contact terminals, one contact terminal electrically connected to each end of each fuse element, a terminal base for mechanically mounting the fuse elements and contact terminals, and a cover configured to engage the terminal base to protect the fuse elements.

More specifically, in one embodiment, the short circuit current limiter includes three poles and respective visual indicators to provide a status of corresponding fuse elements. Insulating barriers fabricated from a fiberglass composite material, both line-to-load and phase-to-phase, to protect the fuse elements from shorting. Alternatively, phase-to-phase barriers are fabricated in the cover. The folded back and switch back configurations of the short circuit current limiter described herein provide a size advantage over known current limiters which employ conventional straight fuse element configurations.

The short circuit current limiter provides protection from short circuits and therefore allows use of less expensive circuit breakers to provide overload protection in electrical circuit configurations. A compact and cost effective current limiter package is provided for combination with smaller sized, less expensive circuit breakers to provide an adequate, affordable, and space-saving circuit protection for both short circuit protection and overload protection. The short circuit current limiter is also configured to be compatible with International Electrotechnical Commission (IEC) style motor starter and motor contactor installations.

DETAILED DESCRIPTION OF THE INVENTION

Figure 1:
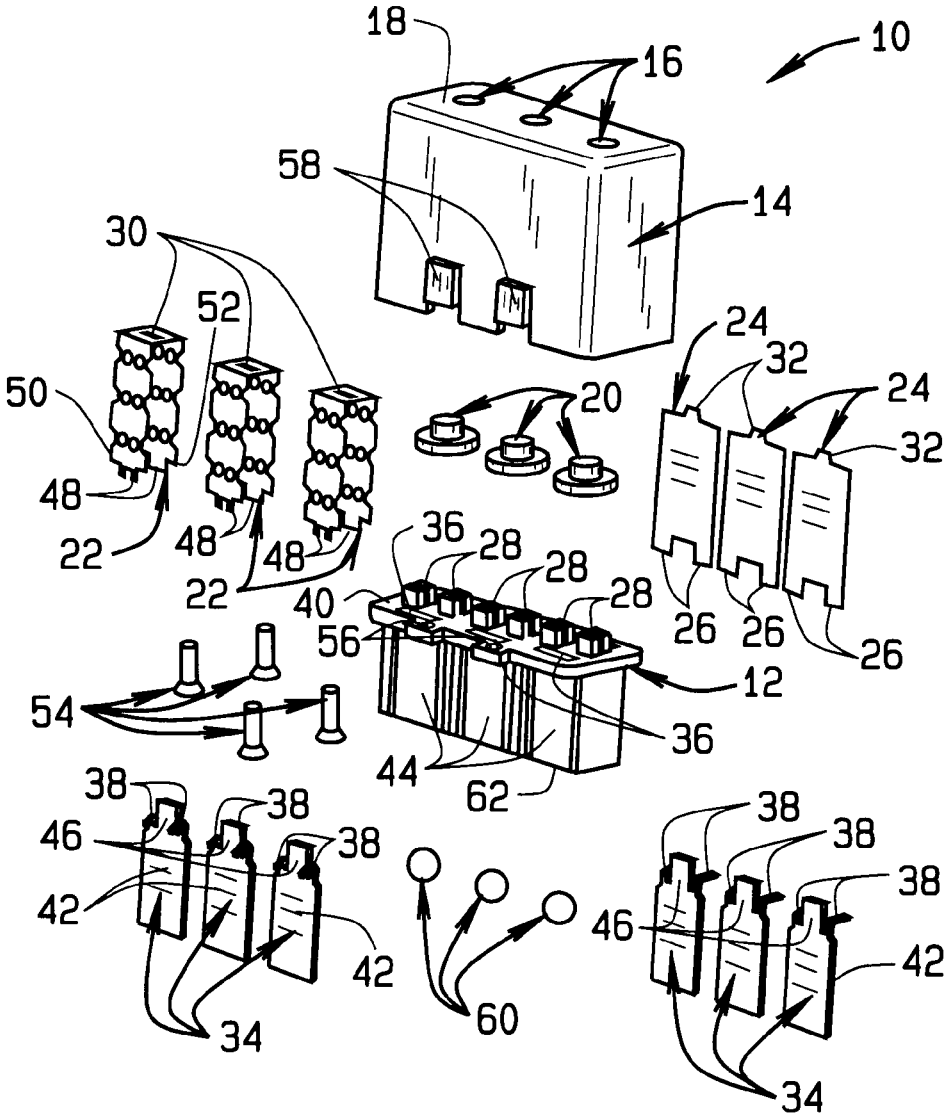
FIG. 1 is an exploded view of a current limiter.

FIG. 1 is an exploded view of an illustrative embodiment of a short circuit current limiter 10 in which the benefits of the invention are demonstrated. It is recognized, however, that current limiter 10 is but one type of electrical component in which the benefits of the invention may be appreciated. Thus, the description set forth below is for illustrative purposes only, and it is contemplated that benefits of the invention accrue to other sizes and types of fuses and current limiters. Therefore, there is no intention to limit practice of the inventive concepts herein solely to the illustrative embodiment described, that is short circuit current limiter 10.

Current limiter 10 includes a base 12 and a cover 14 which, in an exemplary embodiment, are fabricated from thermoset and thermoplastic materials according to known methods and techniques, including, but not limited to, molding operations. A plurality of apertures 16 are formed through a top surface 18 of cover 14. Indicators 20 are configured to be inserted into cover 14 by insertion into apertures 16, and usually indicate a status of each pole of the current limiter. Current limiter 10 is illustrated as a three pole device although the invention should not be construed as being so limited, as fewer or additional poles could be employed in such a fusing device. In one embodiment, indicators 20 are fabricated from a temperature sensitive material that appears white when current limiter 10 is intact, i.e., operative or unopened. Upon a short circuit condition, fuse elements 22 heat and eventually melt, opening the circuit, and the associated heat causes indicators 20 to turn black. In one exemplary embodiment, the primary material in indicator 20 is a micro-crystalline organic wax applied to a black colored substrate. In alternative embodiments, other color schemes may be employed to indicate current limiter status, and in further embodiments, other known indicator mechanisms may be employed in lieu of indicators 20.

Line-to-load insulating barriers 24 for each fuse element 22 are used to protect fuse elements 22 from shorting. Fuse elements 22 employ a folded back configuration to reduce size of current limiter 10. More specifically, in the illustrated embodiment, fuse elements 22 are substantially U-shaped and includes first and second portions extending substantially parallel to one another, and a third portion extending substantially perpendicular to and joining the first and second sections. In alternative embodiments, other fuse element configurations are employed to reduce a size of current limiter 10 without reducing lineal length of fuse elements 22. In addition, fuse elements 22 include a number of constrictions or holes to reduce a cross-sectional area of the fuse elements so that the fuse elements melt, disintegrate, or otherwise open at predetermined current levels dependent upon fuse element dimensions and characteristics.

Insulating barriers 24 are configured with tabs 26 which are inserted into slots 28 formed in base 12, for ease in assembling current limiter 10 and to support insulating barriers 24. In one specific embodiment, insulating barriers 24 are fabricated from a fiberglass composite material.

Fuse elements 22 include slots 30 which receive protrusions 32 on insulating barriers 24 as fuse elements 22 are mounted on base 12. Contact terminals 34 are inserted into openings 36 in base 12 until mounting rests 38 engage surface 40 of base 12, at which time a back surface 42 of contact terminals 34 is supported against a support surface 44 of base 12. Once in place, contact terminals 34 are electrically connected to fuse elements 22. The electrical connection is accomplished when tabs 46 of contact terminals 34 are engaged by crimps 48 which are formed into a first end 50 and a second end 52 of fuse elements 22. Additionally, crimps 48 and tabs 46 are electrically bonded via known methods and techniques, such as a welding or soldering process, and may be bonded before insertion into base 12.

Fasteners 54 are inserted through attachment openings 56 formed into base 12 and are used to attach cover 14 to base 12 at cover attachment points 58. Plugs 60 are inserted into filling holes (not shown) in a bottom 62 of base 12 after the current limiter 10 has been filled with an arc quenching media (not shown), such as quartz silica sand, in an exemplary embodiment, which absorbs arc energy when fuse element 22 opens.

Figure 2:
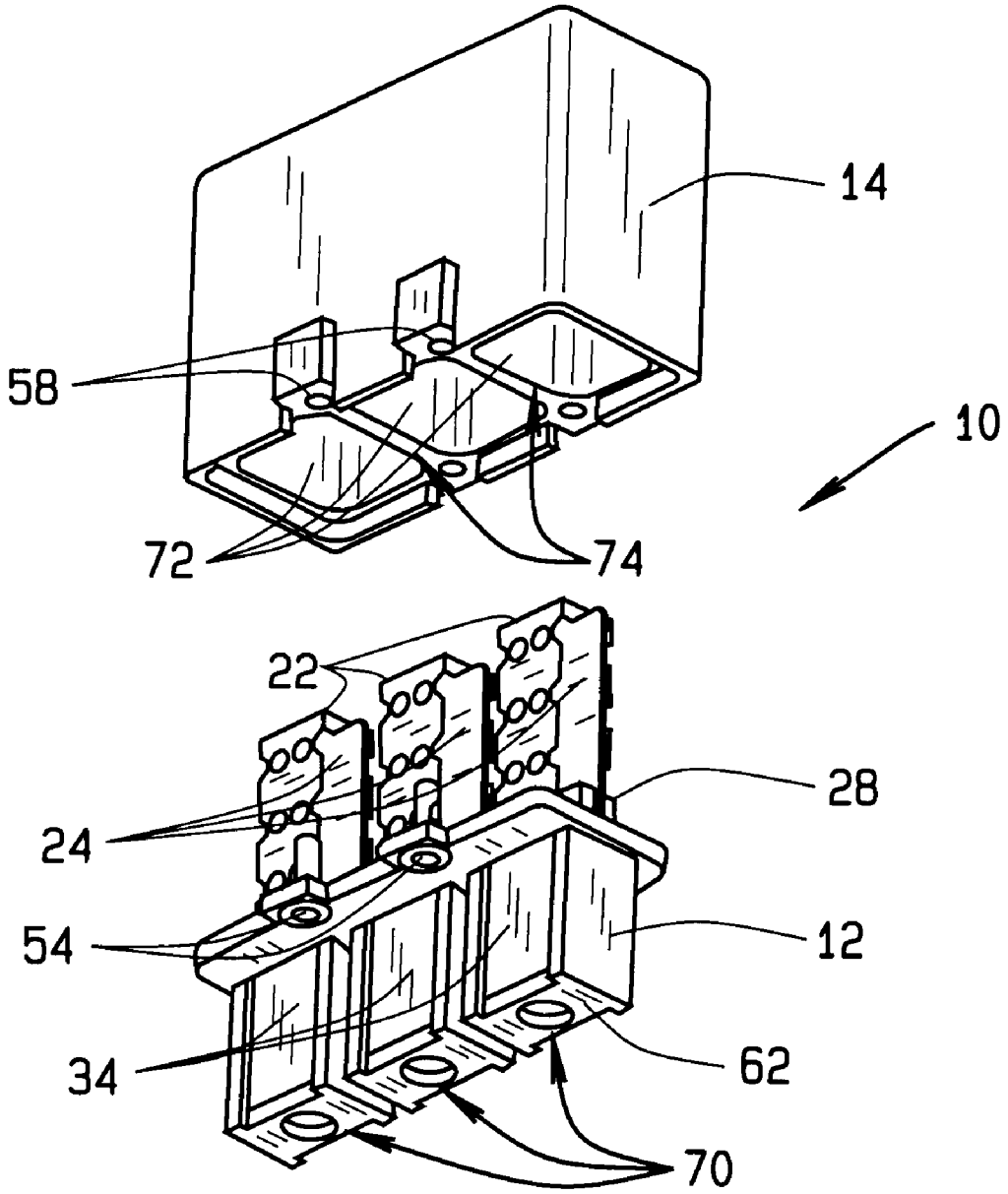
FIG. 2 is an exploded assembly view of the current limiter shown in FIG. 1.

FIG. 2 is a partially assembled view of current limiter 10 illustrating fuse elements 22, insulating barriers 24 and contact terminals 34 inserted into base 12. Fasteners 54 are also shown inserted into base 12. Arc quenching media filling holes 70 extend through bottom 62 of base 12. Referring to cover 14, attachment points 58 extend from cover 12 for engagement with fasteners 54 to attach base 12 to cover 14. In alternative embodiments, other attachment methods are employed, including, but not limited to, riveting and ultrasonic welding processes.

Cover 14 includes a plurality of chambers 72 defined by insulating phase-to-phase barriers 74. Phase-to-phase barriers 74 prevent fuse elements 22 from shorting when cover 14 is installed onto base 12, since when installed, each individual chamber 72 houses a single fuse element 22.

Figure 3:
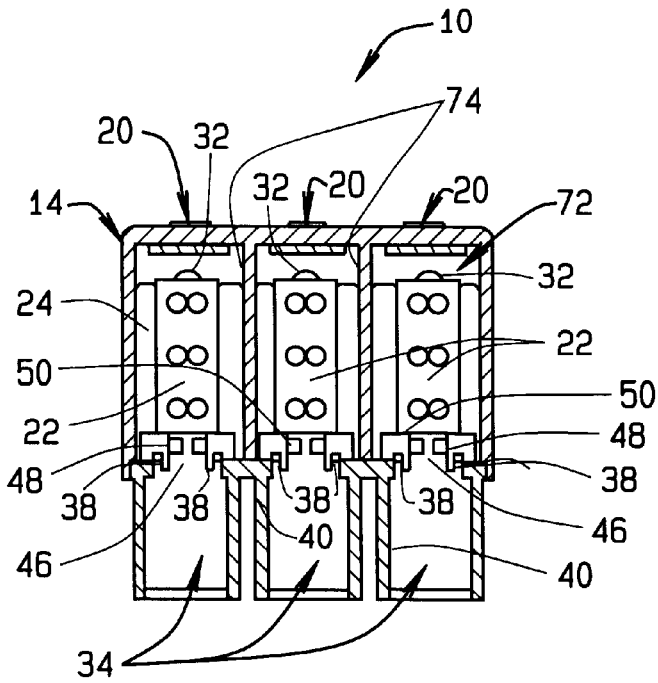
FIG. 3 is a cross-sectional view of the current limiter shown in FIGS. 1 and 2.

FIG. 3 is a side cross-sectional view of an assembled current limiter 10 including indicators 20 inserted through cover 14 and further including fuse elements 22 engaged with protrusions 32 of line-to-load insulating barriers 24. Contact terminal mounting rests 38 engage surface 40 of base 12. Tabs 46 engage crimps 48 molded into first end 50 and second end (shown in FIG. 1) of fuse elements 22 to establish an electrical connection of contact terminals 34 to fuse elements 22. Phase-to-phase barriers 74 prevent fuse elements 22 from shorting to one another when cover 14 is installed onto base 12, providing each fuse element 22 with an individual chamber 72.

Figure 4:
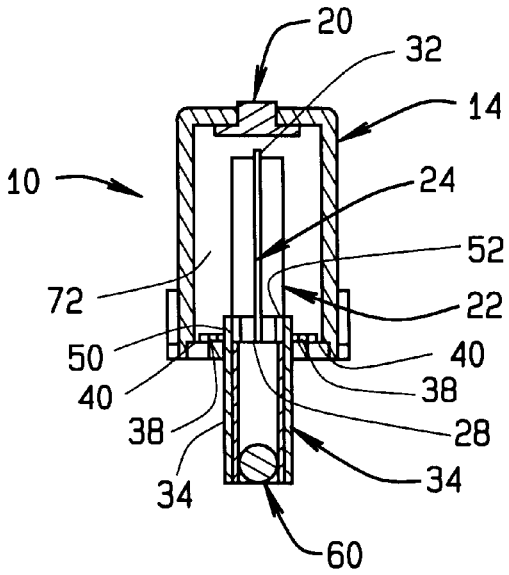
FIG. 4 is another cross-sectional view of the current limiter shown in FIGS. 1 and 2.

FIG. 4 is an end cross-sectional view of an assembled current limiter 10. Current limiter 10 includes indicators 20 inserted into cover 14 and further includes folded back fuse elements 22 inserted onto protrusions 32 of line-to-load insulating barriers 24. Insulating barriers 24 prevent fuse elements 22 from short circuiting, thereby compromising the short circuit detection capability of current limiter 10. Insulating barrier 24 and fuse element 22 are positioned within a chamber 72 when cover 14 is attached to base 12. Contact terminal mounting rests 38 engage, or rest upon surface 40 of base 12. Mounting rests 38 of contact terminals 34 rest upon surface 40 of base 12 when contact terminals 34 are inserted into base 12 as previously described.

Figure 5:
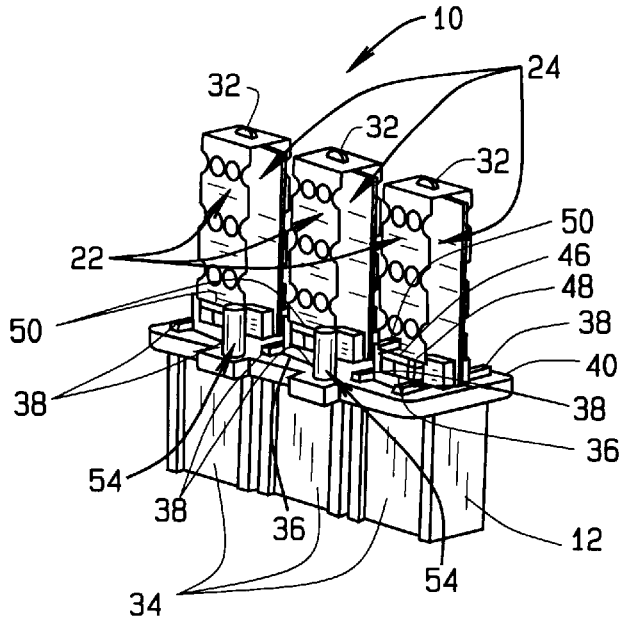
FIG. 5 is a partial assembly view of the current limiter shown in FIGS. 1–4.

FIG. 5 is another partially assembled view of current limiter 10 including protrusions 32 of insulating barriers 24 inserted into slots 30 (shown in FIG. 1) of fuse elements 22. Crimps 48 at first ends 50 of fuse elements 22 engage tabs 46 of contact terminals 34, and contact terminal mounting rests 38 rest on surface 40 of base 12 after insertion of contact terminals 34 into molded openings 36 of base 12. Fasteners 54 are inserted into attachment holes 56 (shown in FIG. 1) of base 12.

Figure 6:
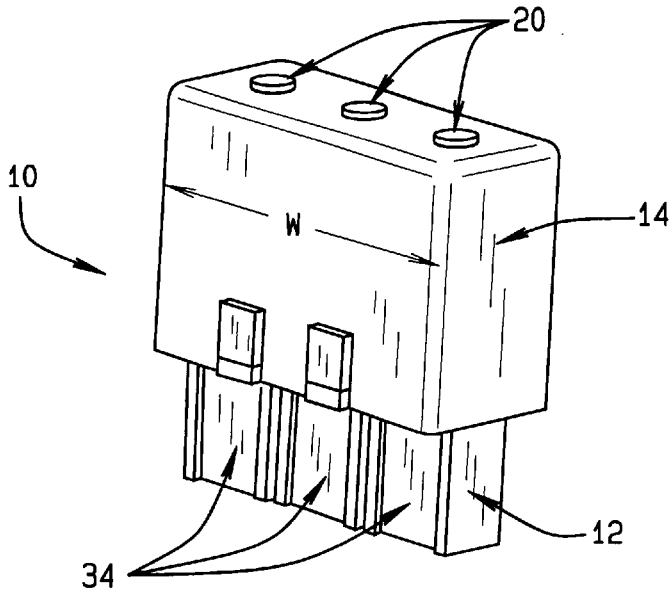
FIG. 6 is a perspective view of an assembled current limiter shown in FIGS. 1–5.

FIG. 6 is an assembled view of current limiter 10 showing indicators 20 inserted into cover 14 and contact terminals 34 as installed into base 12. Current limiter 10 is configured to protect electrical equipment and circuit breakers from short circuit currents, which are many times larger than normal operating currents. Further, current limiter 10 provides the rapid isolation necessary to protect the electrical circuits from such excessive currents. To provide such protection, current limiter 10 is inserted in an electrical circuit where one or more of contact terminals 34 connect to an electrical power source and other contact terminals 34 connect to an electrical component or a combination of components, thereby providing an electrical current path through limiter 10. Upon the occurrence of a short circuit condition within the electrical circuit which exceeds a predetermined value, at least one of fuse elements 22 will melt or disintegrate, the heat generating by such melting or disintegration causing indicators 20 to change state, as described above, and of course, preventing further current flow to the electrical equipment, from the electrical power source, since the current path is broken.

Figure 7:
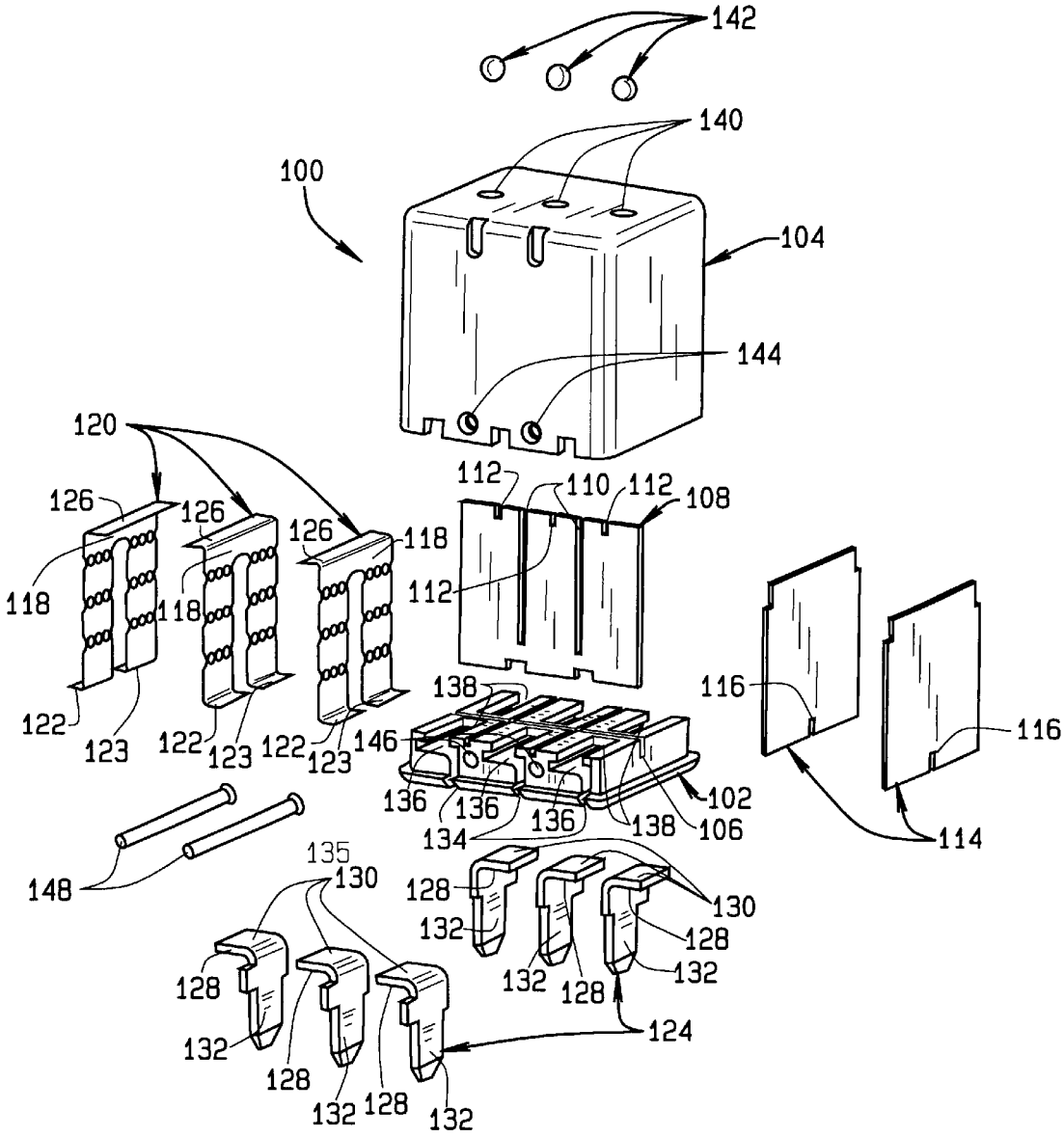
FIG. 7 is an exploded view of a second embodiment of a current limiter.

FIG. 7 is an exploded view of a current limiter 100 in an alternative embodiment of the present invention. Current limiter 100 includes a base 102 and a cover 104. Base 102 includes a longitudinal slot 106 into which a multi-phase line-to-load insulating barrier 108 is inserted. Barrier 108 includes both a plurality of phase barrier mounting slots 110 and a plurality of fuse element mounting notches 112. Phase barrier mounting slots 110 are used to engage phase barriers 114, which also include mounting notches 116 which engage barrier 108 as phase barriers are fitted onto barrier 108. Fuse element mounting notches 112 engage mounting notches 118 on switch back fuse elements 120.

Switch back fuse elements 120, as used herein refer to a fuse element which includes first and second portions aligned with one another in a single plane and a third bridge portion joining an upper end of each of the first and second portions. In contrast to folded back fuse elements 22 (shown in FIGS. 1–6), switch back fuse elements are substantially planar fuse elements, yet, like folded back fuse elements 22, are disposed in a compact area without reducing lineal length of the fuse elements. Further, fuse elements 120 include a first end 122 and a second end 123 which make electrical contact with side-installed contacts 124 and a bent flat member 126 at a right angle to the plane of fuse element 120 which provides stiffness to the thin metal used in construction of fuse elements 120. Contacts 124 are L-shaped and include a bottom surface 128, an upper surface 130, and a vertical portion 132.

Contacts 124 are inserted into base 102 using contact mounting slots 134 which are fabricated into base 102. Contact mounting slots 134 include a contact resting surface 136 onto which a bottom surface 128 of contacts 124 rests when contacts 124 are fitted into contact mounting slots 134. Contact mounting slots 134 further include an upper opening 138 through which ends 122 and 123 of fuse elements 120 come to rest upon upper surface 130 of contacts 124.

Cover 104 includes arc quenching media filling holes 140 into which, in an exemplary embodiment, quartz silica sand is inserted to absorb arc energy when current limiter 100 opens or operates. After filling, plugs 142 are inserted into filling holes 140. Cover 104 further includes riveting holes 144 which align with riveting holes 146 in base 102 when cover 104 is fitted onto base 102. In an exemplary embodiment, rivets 148 are used to attach base 102 to cover 104 and are inserted into riveting holes 144 and 146 as is well known. Of course other attachment methods may be employed to attach cover 104 to base 102 including, but not limited to, ultrasonic welding processes and other attachment means, for example, screws.

Figure 8:
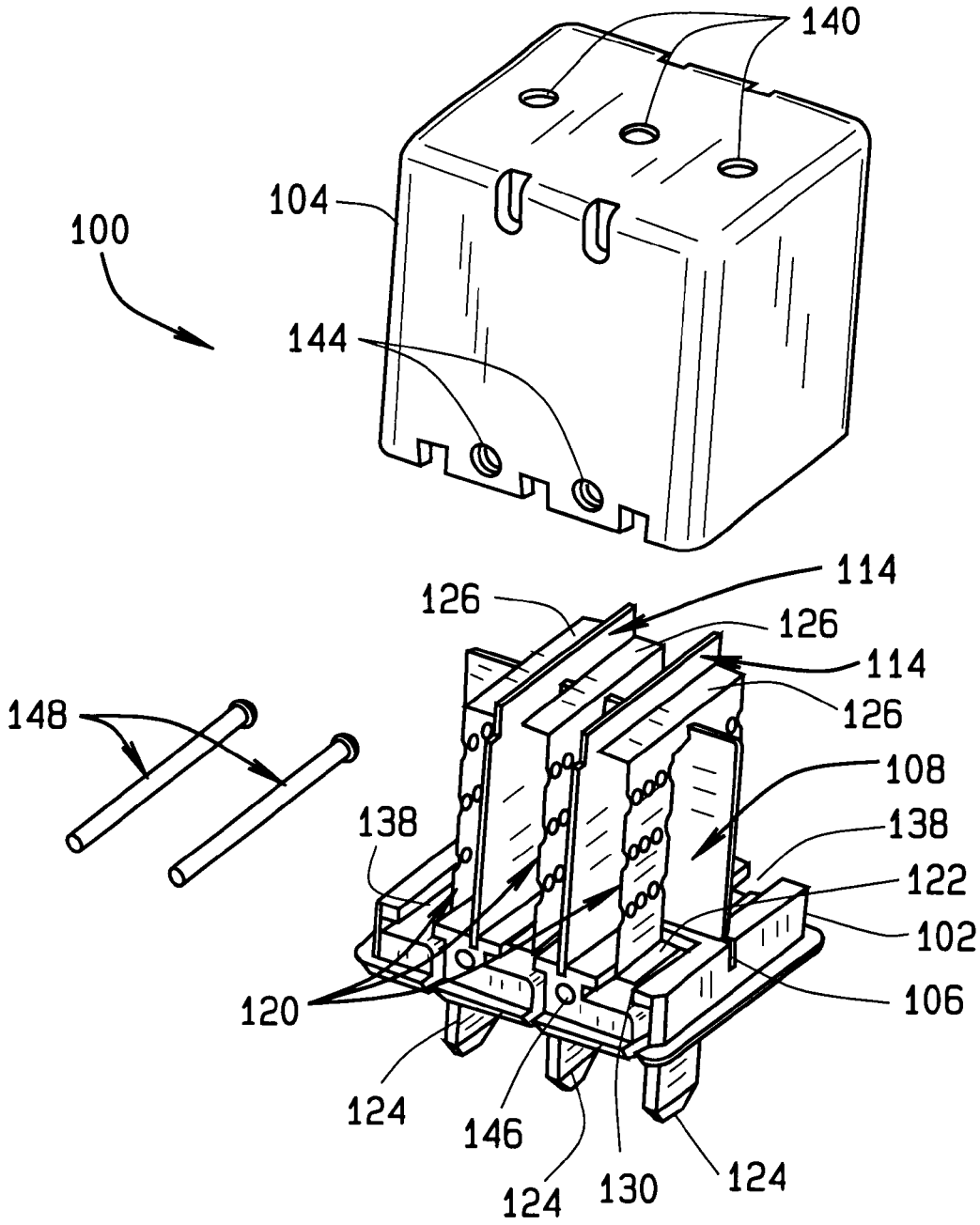
FIG. 8 is a partial assembly view of the current limiter shown in FIG. 7.

FIG. 8 is a partial assembly view of current limiter 100 and illustrates a physical relationship of base 102, multi-phase line-to-load insulating barrier 108, phase barriers 114, and fuse elements 120. Further illustrated are first ends 122 and second ends 123 (shown in FIG. 7) of fuse elements 120 contacting upper surfaces 130 of contacts 124. Ends 122 and 123 are, in alternative embodiments, soldered or welded to upper surfaces 130.

Figure 9:
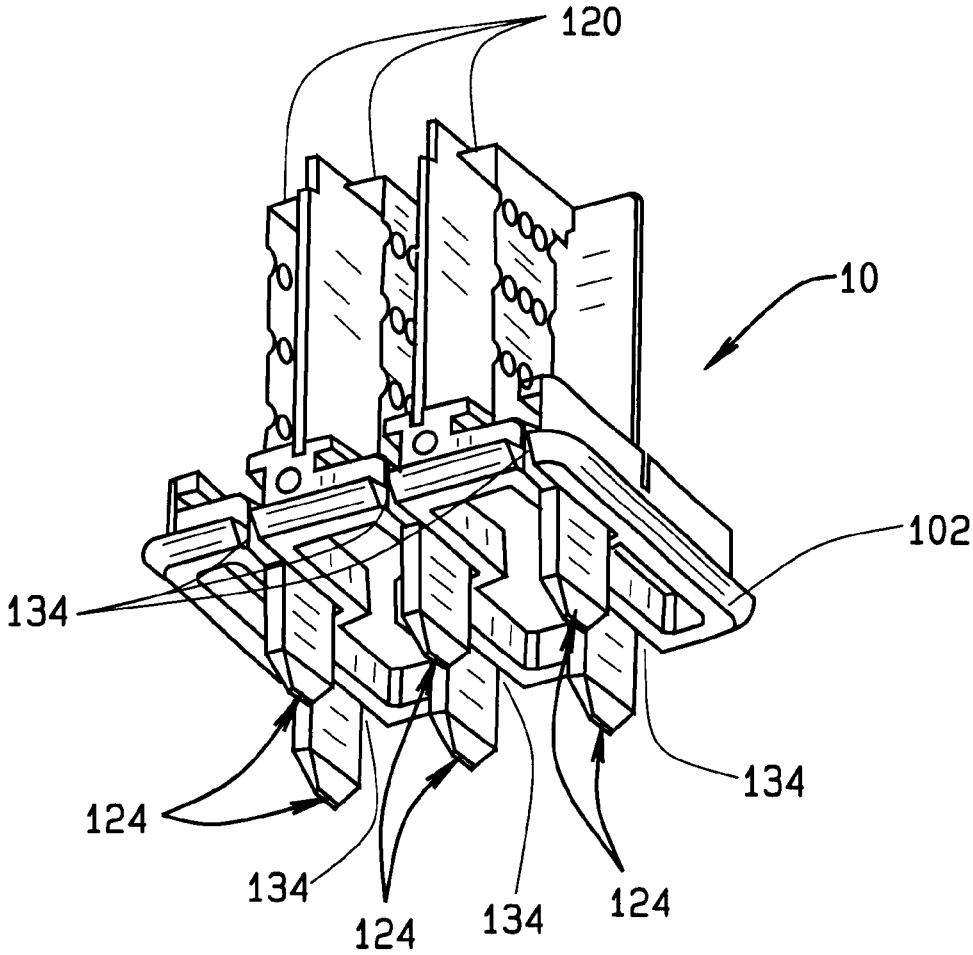
FIG. 9 is a perspective view of a portion of the current limiter shown in FIGS. 7 and 8.

FIG. 9 is a partial assembly view of current limiter 100 which illustrates that contact mounting slots 134, and therefore contacts 124 for each fuse element 120 are offset from one another, that is, from line to load, to provide an adequate space between contacts 124 for compliance with various component regulatory agencies.

Figure 10:
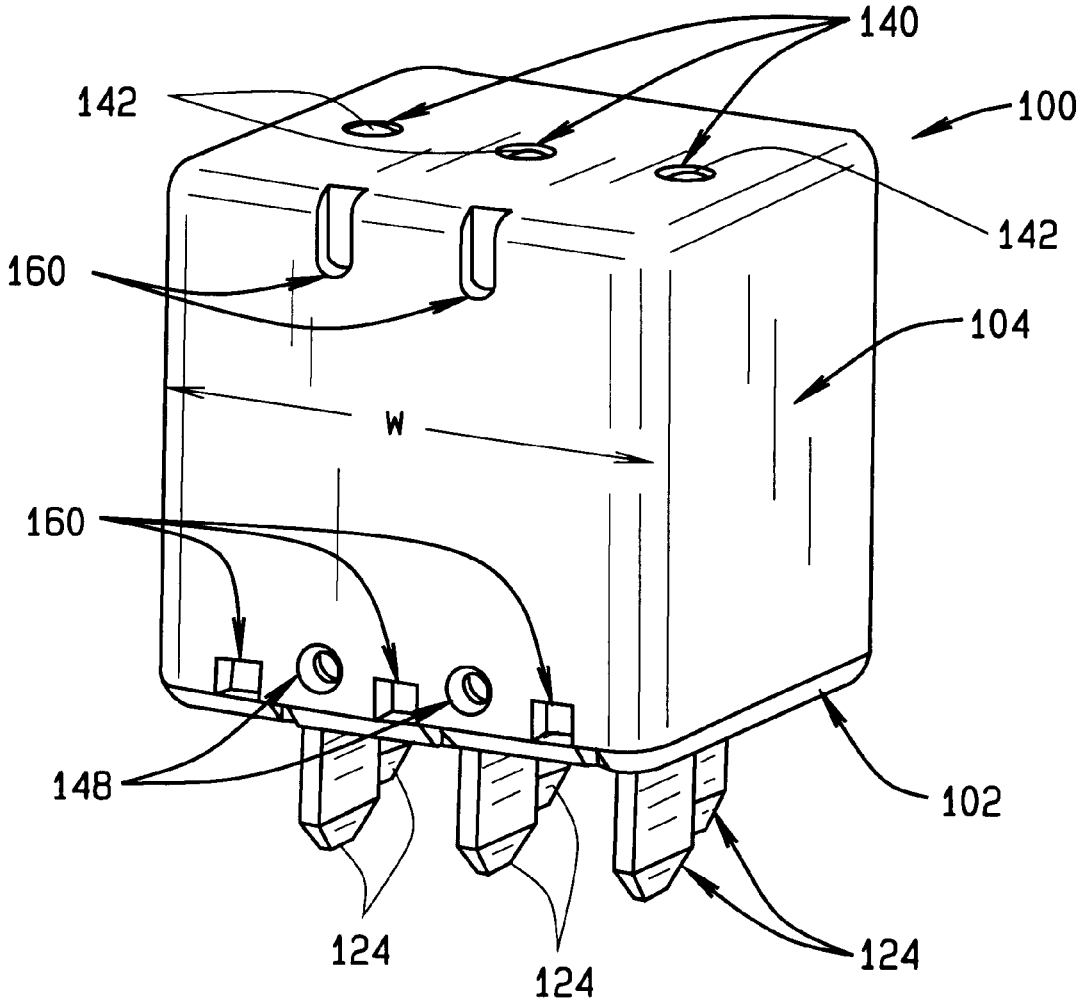
FIG. 10 is a perspective view of an assembled current limiter shown in FIGS. 7–9.

FIG. 10 is a view of a completely assembled current limiter 100, with cover 104 attached to base 102 using rivets 148. A chamber (not shown) defined by the space enclosed by cover 104 has been filled with an arc quenching media, for example, sand (not shown) using filling holes 140 which have been subsequently plugged using plugs 142. Contacts 124 are electrically connected to fuse elements 120 (shown in FIGS. 7–9) and are exposed and configured for insertion into an electrical circuit (not shown). Cover 104 is further configured with a plurality of notches and indentations, collectively referred to herein as mounting features 160, which are used for hooking or securing current limiter 100 into an interface block (not shown) or other mounting devices (not shown) within an electrical application.

Aside from the noted structural differences, current limiter 100 operates similar to current limiter 10 as described above.

Current limiter 10 (shown in FIGS. 1–6) and current limiter 100 (shown in FIGS. 7–10) provide an economical way to protect electrical circuit from short circuits, and further allow circuit designers to incorporate circuit breakers for overload protection, which are smaller and much less expensive than known circuit breakers which can provide short circuit protection. Further, short circuit current limiters 10 and 100 are configurable for insertion into International Electrotechnical Commission (IEC) style motor starter and motor contactor installations, and in one particular embodiment, and denoted by dimension W in FIGS. 6 and 10, are about 45 mm wide for a 30 Ampere rated current limiter.

While the embodiments described above pertain predominately to short circuit only protection devices for use in combination with circuit breaking devices, it is contemplated that aspects of the present invention could be applied generally to fused devices providing additional fault current protection, including but not limited to full range fuse elements.

While the invention has been described in terms of various specific embodiments, those skilled in the art will recognize that the invention can be practiced with modification within the spirit and scope of the claims.

What is claimed is:

1. A short circuit current limiter comprising:

at least one fuse element comprising a first end and a second end, said fuse element incorporating one of a folded back configuration or a switch back configuration;

a plurality of contact terminals, one of said contact terminals electrically connected to each said end of each said fuse element;

a terminal base for mechanically mounting said fuse elements and said contact terminals;

at least one line-to-load insulating barrier for each fuse element; and a cover configured to engage said terminal base to protect said fuse elements.

2. A short circuit current limiter according to claim 1 comprising three fuse elements, and wherein said current limiter is about 45 mm in width.

3. A short circuit current limiter according to claim 1 wherein said cover and said terminal base are fabricated from a thermoplastic.

4. A short circuit current limiter according to claim 1 wherein the line-to-load insulating barriers are fabricated from a fiberglass composite material.

5. A short circuit current limiter according to claim 1 wherein said contact terminals and said ends of said fuse elements are electrically connected by one of welding and soldering.

6. A short circuit current limiter according to claim 1 wherein said cover is configured with insulating phase-to-phase barriers to prevent multiple fuse elements from shorting to one another.

7. A short circuit current limiter according to claim 1 further comprising insulating phase barriers inserted into phase barrier mounting slot in said base to prevent said fuse elements from shorting to one another.

8. A short circuit current limiter according to claim 1 wherein said current limiter incorporates fuse elements with a switch back configuration, said fuse elements further comprising a bent flat member to provide stiffness to said fuse element.

9. A short circuit current limiter according to claim 1 further comprising a visual indicator to show a status of each of said fuse elements.

10. A short circuit current limiter according to claim 9 wherein said visual indicators comprise a micro-crystalline organic wax applied to a black color substrate.

11. A current limiter comprising:

a plurality of short circuit fuse elements incorporating one of a folded back configuration or a switch back configuration, said fuse elements having a first end and a second end;

a plurality of contact terminals, one of said contact terminals electrically connected to each said end of each said fuse element;

a terminal base for mechanically mounting said fuse elements and said contact terminals;

insulating phase barriers separating adjacent fuse elements to prevent adjacent fuse elements from shorting to one another; and a cover configured to engage said terminal base to protect said fuse elements.

12. A current limiter according to claim 11 wherein said current limiter is about 45 mm in width.

13. A current limiter according to claim 11 further comprising a visual indicator to show a status of each of said fuse elements.

14. A current limiter according to claim 11 further comprising at least one line-to-load insulating barrier for each fuse element.

15. A three pole current limiter according to claim 11 wherein said insulating phase-to-phase barriers are fabricated into said cover.

16. A three pole current limiter according to claim 11 wherein said insulating phase barriers are inserted into a phase barrier mounting slot in said base to prevent said fuse elements from shorting to one another.

17. A current limiter comprising:

at least one short circuit only fuse element, said fuse element being substantially U-shaped and comprising a first portion and a second portion extending substantially parallel to one another, and a third portion extending substantially perpendicular to and joining said first and second portions;

first and second contact terminals coupled to said at least one fuse element, said at least one fuse element extending between said contact terminals;

a terminal base for mechanically mounting said at least one fuse element and said contact terminals;

a line-to-load insulating barrier extending between said first portion and said second portion of said fuse element; and a cover configured to engage said terminal base to protect said at least one fuse element.

18. A current limiter comprising:

a terminal base;

at least one pair of contact terminals attached to said base, each pair of contact terminals including contact portions extending on opposite sides of said base;

a cover configured for attachment to said base, at least one of said base and said cover comprising a barrier defining a compartment; and a short circuit only fuse element disposed within said compartment when said cover is attached to said base, said fuse element comprising a first end and a second end, said fuse element engaged to said barrier and said first and second ends of said fuse element coupled to one of said at least one pair of contact terminals.

19. A current limiter according to claim 17 further comprising at least one fuse element indicator visible through said cover.

20. A current limiter according to claim 17 comprising three short circuit only fuse elements.

* * * * *